US007108233B2

(12) United States Patent
Giuseppin

(10) Patent No.: US 7,108,233 B2
(45) Date of Patent: Sep. 19, 2006

(54) WIRE RING NET FOR ROCKY WALL BARRIERS AND METHOD FOR MAKING IT

(76) Inventor: Mauro Giuseppin, Via Brigata Acquit,9, I-38100 Trento (IT)

( * ) Notice: Subject to any disclaimer, the term of this patent is extended or adjusted under 35 U.S.C. 154(b) by 27 days.

(21) Appl. No.: 10/910,444

(22) Filed: Aug. 3, 2004

(65) Prior Publication Data

US 2005/0029408 A1 Feb. 10, 2005

(51) Int. Cl.
*B21F 27/00* (2006.01)
*B29D 30/48* (2006.01)

(52) U.S. Cl. ..... 245/5; 245/6; 245/1; 140/88; 140/92.3; 428/592; 256/32

(58) Field of Classification Search ..... 140/88, 140/92.3; 428/592, 608; 87/8, 9, 10, 11, 87/12; 52/343, 660; 245/1–1.1, 1.5; 256/32, 256/45; 403/384; 404/134
See application file for complete search history.

(56) References Cited

U.S. PATENT DOCUMENTS 1,429,123 A * 9/1922 Beyea ..... 245/1.5
1,464,720 A * 8/1923 Mandalian ..... 57/212
1,512,795 A * 10/1924 Pierce ..... 245/1.5
1,513,578 A * 10/1924 Bente et al. ..... 87/10
1,514,902 A * 11/1924 Gilmore ..... 52/660
1,522,798 A * 1/1925 Beyea ..... 245/1.5
1,565,616 A * 12/1925 Beyea ..... 245/1.5
1,686,155 A * 10/1928 Hopkins ..... 245/1.5
1,763,179 A * 6/1930 Pierce ..... 245/1.5
1,781,650 A * 11/1930 Teegarden ..... 140/88
1,992,884 A * 2/1935 Pink ..... 245/6
2,020,017 A * 11/1935 Burgess ..... 404/134
2,390,983 A * 12/1945 Bixby ..... 209/392
3,369,317 A * 2/1968 Brownell ..... 43/7
3,512,760 A * 5/1970 Rohrbacher ..... 256/32
3,539,135 A * 11/1970 Berg ..... 245/4
4,022,009 A * 5/1977 van Assendelft ..... 57/212
5,141,032 A * 8/1992 Rausch ..... 140/88
5,215,613 A * 6/1993 Shemenski et al. ..... 156/136
5,477,893 A * 12/1995 Wentzek et al. ..... 140/101
5,597,017 A * 1/1997 Eicher et al. ..... 140/3 B
5,622,094 A * 4/1997 Rexroad ..... 87/12
5,961,099 A * 10/1999 Thommen, Jr. ..... 256/12.5
5,996,972 A * 12/1999 Kaiser ..... 256/12.5
6,027,785 A * 2/2000 Yoshida ..... 428/131
6,076,448 A * 6/2000 Rexroad ..... 87/12
6,279,858 B1 * 8/2001 Eicher ..... 245/8
6,408,732 B1 * 6/2002 Rexroad et al. ..... 87/12
6,457,282 B1 * 10/2002 O'Toole ..... 52/81.2
6,592,103 B1 * 7/2003 Sennhauser ..... 256/12.5
6,945,153 B1 * 9/2005 Knudsen et al. ..... 87/1

FOREIGN PATENT DOCUMENTS

EP 1538265 * 8/2005

* cited by examiner

*Primary Examiner*—John J. Calvert
*Assistant Examiner*—Robert H Muromoto
(74) *Attorney, Agent, or Firm*—James V. Costigan; Hedman & Costigan, P.C.

(57) ABSTRACT

A wire ring net, particularly for providing barriers for rocky walls and the like comprises a plurality of braided wire rings, each wire ring comprising, at a starting end of its wire, a first curled portion wound about the wire of the first turn and, at the terminal, end of the wire, a second curled portion wound about the rope forming the wire ring.

4 Claims, 5 Drawing Sheets

PRIOR ART

WIRE RING NET FOR ROCKY WALL BARRIERS AND METHOD FOR MAKING IT

BACKGROUND OF THE INVENTION

The present invention relates to a wire ring net for making barriers, in particular for rocky walls, and a method for making the net.

As is known, barriers for coating rocky walls and generally comprising a plurality of interlinked ring elements having a diameter from 300 to 450 mm, are already known.

In such a net, each wire ring is made starting from an endless steel rope, having a spiral cross-section including seven wires, which is made by braiding on itself a steel wire which at its starting and end portions is closed by a splicing operation.

As shown in FIGS. 1 and 2, the end portions of the wire forming the rope are re-closed by a metal band 1, which is clamped on the end portions 2 and 3 thereby holding said end portions at a desired position.

The use of the above mentioned band elements, however, has not been found as fully satisfactory since, in a lot of cases, this approach is not able to resist against pulling forces and, accordingly, the ring could be broken.

SUMMARY OF THE INVENTION

Thus, the aim of the present invention is to overcome the above mentioned drawbacks, by providing a wire ring net, specifically designed for making rocky wall barriers, which allows to safely clamp the wire end portions during the making of the individual ring elements, so as to enhance their clamping force under pulling efforts, thereby providing a product having optimum strength and constructional characteristics.

Within the scope of the above mentioned aim, a main object of the present invention is to provide such a wire ring net in which the ring wire can be automatically supplied with a much more strong clamping.

Another object of the present invention is to provide a method for making a wire ring net which is very reliable and safe in operation.

Yet another object of the present invention is to provide such a wire ring net which can be easily made and which, moreover, is very competitive from a mere economic standpoint.

According to one aspect of the present invention, the above mentioned aim and objects, as well as yet other objects, which will become more apparent hereinafter, are achieved by a wire ring net, for making rocky wall barriers, comprising a plurality of mutually braided wire rings, characterized in that each said wire ring comprises, at a starting end of a wire, a first curled portion wound about the wire of the first turn and, at a terminal end of the wire, a second curled portion wound about the rope forming said wire ring.

BRIEF DESCRIPTION OF THE DRAWINGS

Further characteristics and advantages of the present invention will become more apparent hereinafter from the following detailed disclosure of a preferred, though not exclusive, embodiment of a wire ring net for making rocky wall barriers, which is illustrated, by way of an indicative, but not limitative, example, in the accompanying drawings, where.

DESCRIPTION OF THE PREFERRED EMBODIMENT

Figure 2:
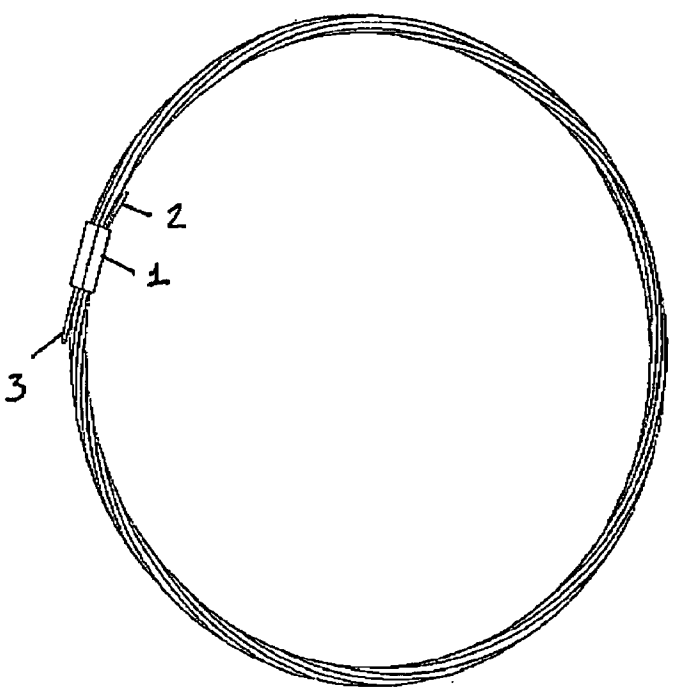
FIG. 2 shows a prior wire ring, after the closure of the band element therefor.
Figure 1:
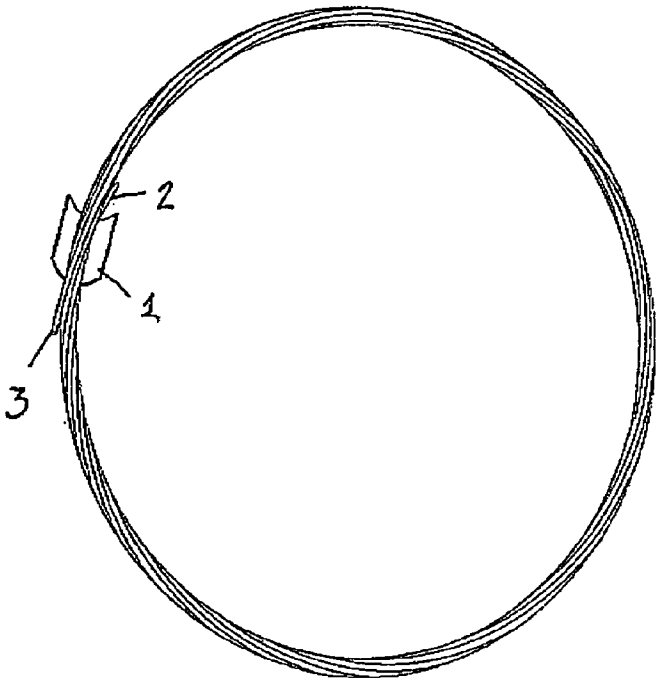
FIG. 1 schematically shows a prior wire ring, before closing the band element therefor.
Figure 3:
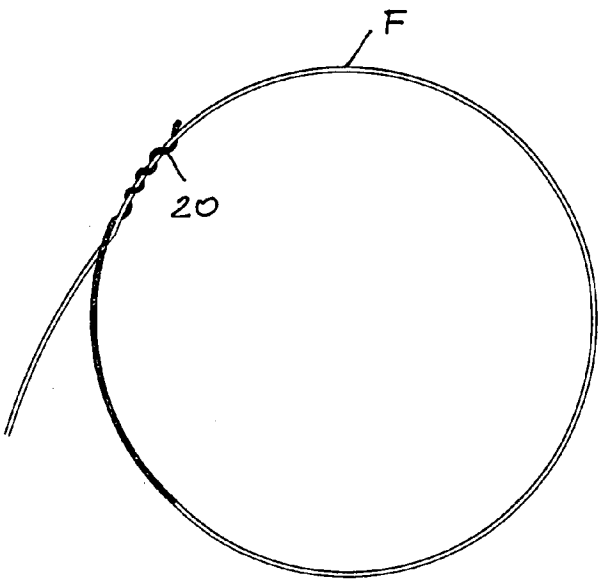
FIG. 3 shows a wire ring according to the present invention, as the first curled portion thereof is formed.
Figure 6:
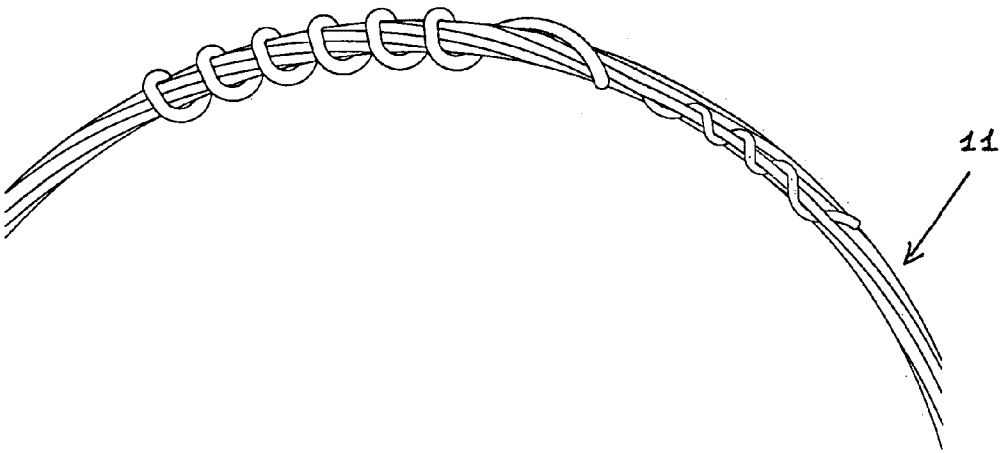
FIG. 6 shows a detail of the first and second curled portions.
Figure 4:
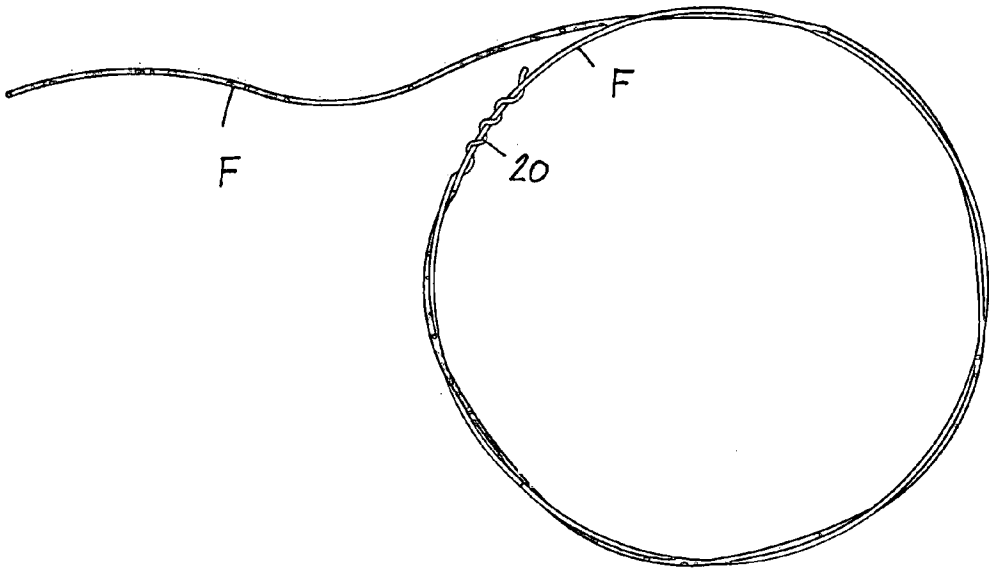
FIG. 4 schematically shows the spiral winding of the wire ring.
Figure 5:
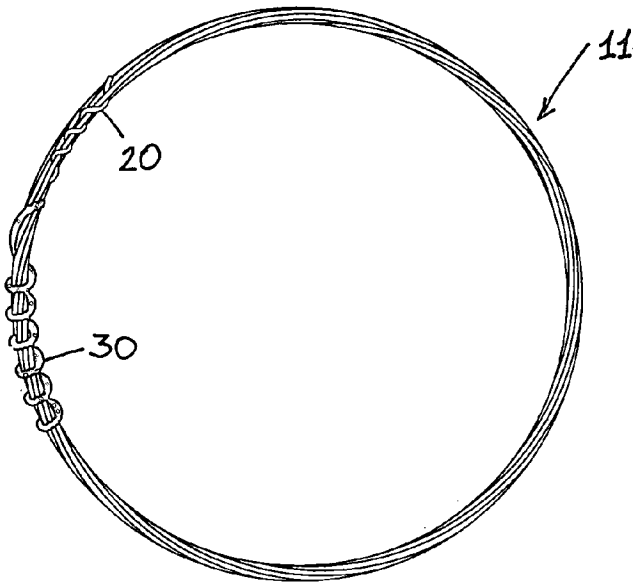
FIG. 5 shows the making of the second curled portion.
Figure 7:
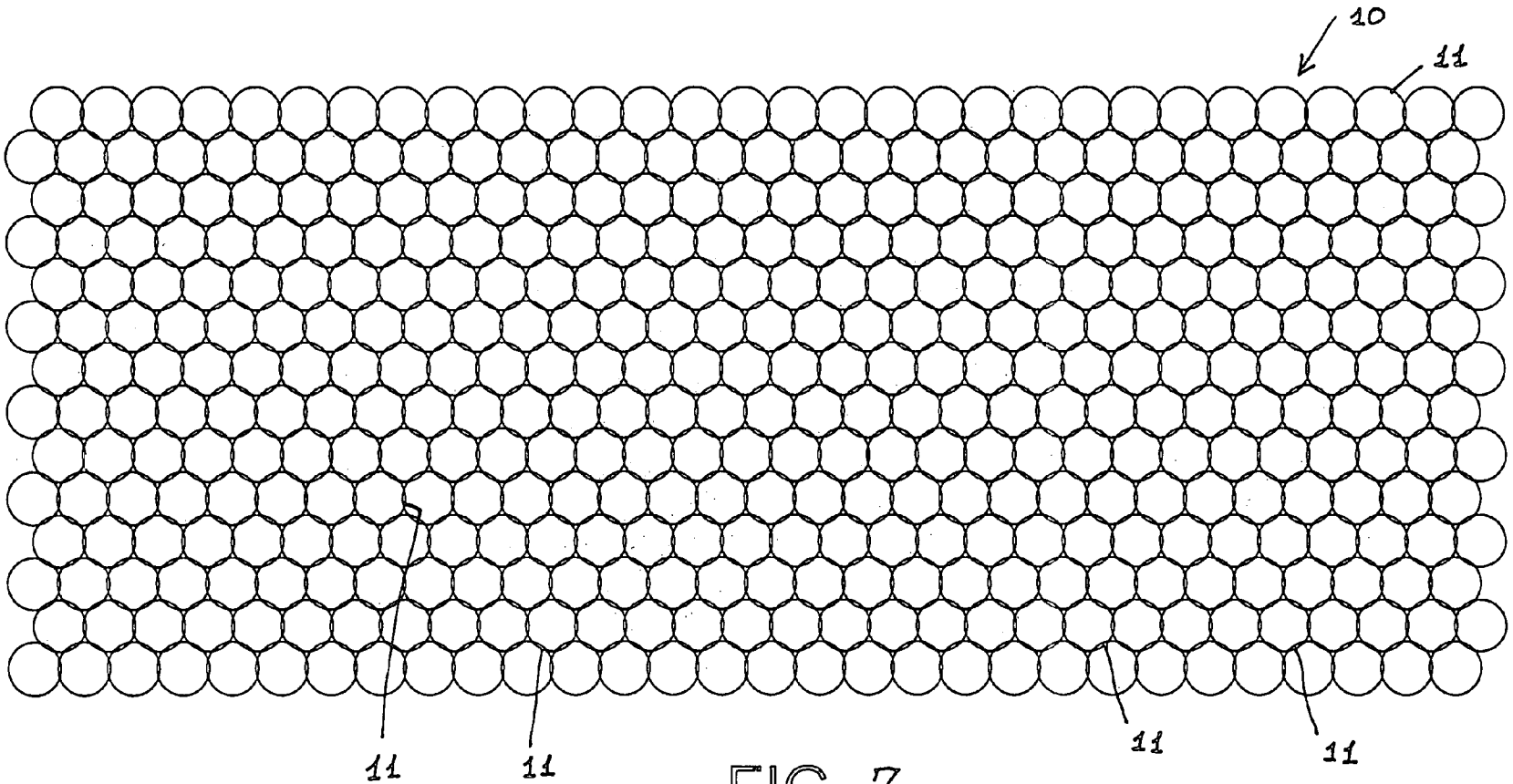
FIG. 7 schematically shows a wire ring net according to the present invention.
Figure 8:
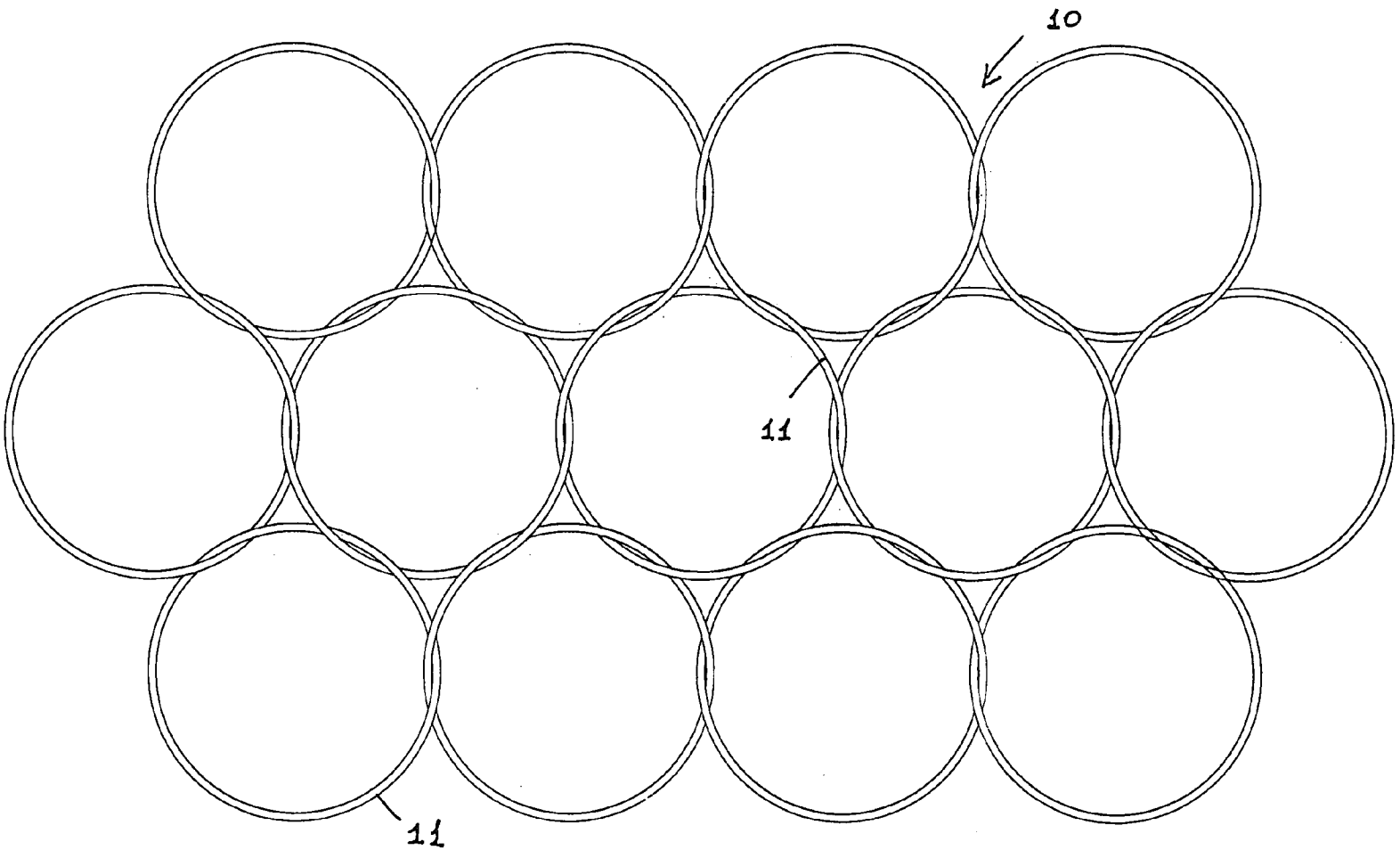
FIG. 8 shows, on an enlarged scale, a detail of the braiding of the wire rings.

With reference to the number reference of the above mentioned figures, the wire ring net according to the present invention, which has been generally indicated by the reference number 10, comprises a plurality of wire rings 11, which are mutually braided so as to provide a mesh.

Each wire ring 11, in particularly, is made starting from a steel wire which, at a starting end thereof, comprises a first curled portion 20, which is wound about the wire, indicated by F, forming the first turn.

After having coupled the starting end, the wire is so wound as to provide a rope including a plurality of turns.

An important aspect of the present invention is that the wire is twisted so as to apply to the wire a helical deformation, allowing it to fit the turn braided arrangement, without any inner stresses, thereby providing the desired end shape.

At the terminal end of the wire is formed a second curled portion 30, which is wound about the rope constituted by the braided wire which, through the seven braided turns, will provide the ring body.

By the above disclosed device, the provision of a double curled portion, i.e. a first curled portion which is wound on a wire and a second curled portion which is wound about the rope, it is possible to provide a clamping which is much stronger than that which is conventionally used.

Moreover, the curled portion forming operation is very simple to automatize, and allows to save a lot of time, while preventing further components, in addition to a wire, from being processed.

From the above disclosure, it should be apparent that invention fully achieves the intended aim and objects.

In fact, the curled portion will greatly simplify the clamping of the wire end portions.

Moreover, the operation consisting of providing the wire with a helical preforming, would allow the wire to fit without any inner stress to the strand helix pitch.

The invention, as disclosed, is susceptible to several modifications and variations, all of which will come within the scope of the invention.

Moreover, all the constructional details can be replaced by other technically equivalent elements.

In practicing the invention, the used materials, provided that they are compatible to the intended application, as well as the contingent shape and size, can be any, depending on requirements.

The invention claimed is:

1. A steel wire ring net, for making barriers for rocky walls, said wire ring net being made of a plurality of braided steel wires and comprising a plurality of mutually braided steel wire rings, each said wire ring including a plurality of braided spiral wire turns forming a wire rope, wherein each said steel wire ring further comprises, at a starting end of each steel wire, a first starting end curled portion which is only wound about the steel wire of the first steel wire turn and, at a terminal end of the steel wire, a second terminal end curled portion wound about said steel wire rope.

2. A steel ware ring net, according to claim 1, wherein said steel wire is pre-formed by subjecting said steel wire to a twisting helical deformation to fit said steel wire to an end shape without inner stresses.

3. A method for making a steel wire ring net, for making barriers for rocky walls, said net being formed from steel wire material, wherein said method comprises the steps of providing a steel wire material, forming a plurality of mutually braided steel wire rings, each said steel wire ring including a plurality of braided spiral steel wire turns forming a steel wire rope, forming, at a first end of each said steel wire ring a first curled portion and, at a second end of each said steel wire ring, a second curled portion and winding said first curled portion only about said first steel wire turn and said second curled portion about said steel wire rope.

4. A method according to claim 3, wherein said method further comprises a preliminary step of helically twisting each said steel wire to allow said steel wire to fit inner stresses of a final shape thereof.

* * * * *